US010622179B2

(12) United States Patent
Gonthier et al.

(10) Patent No.: US 10,622,179 B2
(45) Date of Patent: Apr. 14, 2020

(54) BREAKER DEVICE FOR CONNECTION TO AN ELECTRICAL CIRCUIT

(71) Applicant: ARIANEGROUP SAS, Paris (FR)

(72) Inventors: Gilles Gonthier, Pessac (FR); Frédéric Marlin, Saint Medard en Jalles (FR); Jean-François De Palma, Saint Barthelemy D'Anjou (FR); Rémy Ouaida, Villeurbanne (FR)

(73) Assignee: ARIANEGROUP SAS, Paris (FR)

( * ) Notice: Subject to any disclaimer, the term of this patent is extended or adjusted under 35 U.S.C. 154(b) by 0 days.

(21) Appl. No.: 16/301,663

(22) PCT Filed: May 15, 2017

(86) PCT No.: PCT/FR2017/051168

§ 371 (c)(1),
(2) Date: Nov. 14, 2018

(87) PCT Pub. No.: WO2017/198937

PCT Pub. Date: Nov. 23, 2017

(65) Prior Publication Data

US 2019/0287751 A1 Sep. 19, 2019

(30) Foreign Application Priority Data

May 16, 2016 (FR) ..... 16 54336

(51) Int. Cl.
*H01H 85/10* (2006.01)
*H01H 85/02* (2006.01)
(Continued)

(52) U.S. Cl.
CPC ..... *H01H 85/10* (2013.01); *H01H 39/006* (2013.01); *H01H 85/0241* (2013.01); *H01H 2085/0555* (2013.01)

(58) Field of Classification Search
CPC ..... H01H 85/0241; H01H 85/10; H01H 2085/0555; H01H 39/00; H01H 39/006; H01H 39/008; H01H 85/0039
(Continued)

(56) References Cited

U.S. PATENT DOCUMENTS 5,990,572 A * 11/1999 Yasukuni ..... H01H 39/006 180/271
2005/0034595 A1* 2/2005 Kordel ..... B23D 15/145 89/1.14
(Continued)

FOREIGN PATENT DOCUMENTS

CN 101295610 A 10/2008
CN 101809703 A 8/2010
(Continued)

OTHER PUBLICATIONS

International Preliminary Report on Patentability and the Written Opinion of the International Searching Authority as issued in International Patent Application No. PCT/FR2017/051168, dated Nov. 20, 2018.
(Continued)

*Primary Examiner* — Jacob R Crum
(74) *Attorney, Agent, or Firm* — Pillsbury Winthrop Shaw Pittman LLP

(57) ABSTRACT

A breaker device for connecting in an electrical circuit, the device includes a pyrotechnic initiator and a body having present therein: a pressurizing chamber in communication with an outlet from the pyrotechnic initiator; at least one electrically conductive portion for connection to the electrical circuit; at least one fusible element connected in series with the conductive portion, the initiator being connected to the terminals of the fusible element and the fusible element being configured to trip when the current passing through it exceeds a predetermined value, thereby actuating the initia-
(Continued)

tor; and a movable breaker element; the pyrotechnic initiator being configured to cause the breaker device to pass from a current-passing first configuration to a circuit-breaking second configuration, the movable breaker element being moved on passing from the first configuration to the second in order to disconnect the conductive portion.

9 Claims, 7 Drawing Sheets

(51) Int. Cl.
*H01H 39/00* (2006.01)
*H01H 85/055* (2006.01)

(58) Field of Classification Search
USPC ..... 337/142
See application file for complete search history.

(56) References Cited

U.S. PATENT DOCUMENTS

2005/0083164 A1* 4/2005 Caruso ..... H01H 39/006 337/157
2008/0137253 A1* 6/2008 George ..... H01H 9/106 361/93.1
2013/0056344 A1* 3/2013 Borg ..... H01H 39/00 200/81 R
2014/0061011 A1* 3/2014 Nakamura ..... H01H 39/006 200/61.08
2015/0206681 A1* 7/2015 Marlin ..... H01H 1/365 200/82 R

FOREIGN PATENT DOCUMENTS

DE 197 12 387 A1 10/1997
DE 20 2015 106793 U1 1/2016
FR 2 775 539 A1 9/1999
FR 2 797 990 A1 3/2001
GB 2 489 101 A 9/2012
JP 2014-049272 A 3/2014

OTHER PUBLICATIONS

International Search Report as issued in International Patent Application No. PCT/FR2017/051168, dated Jul. 25, 2017.

* cited by examiner

FIG.1
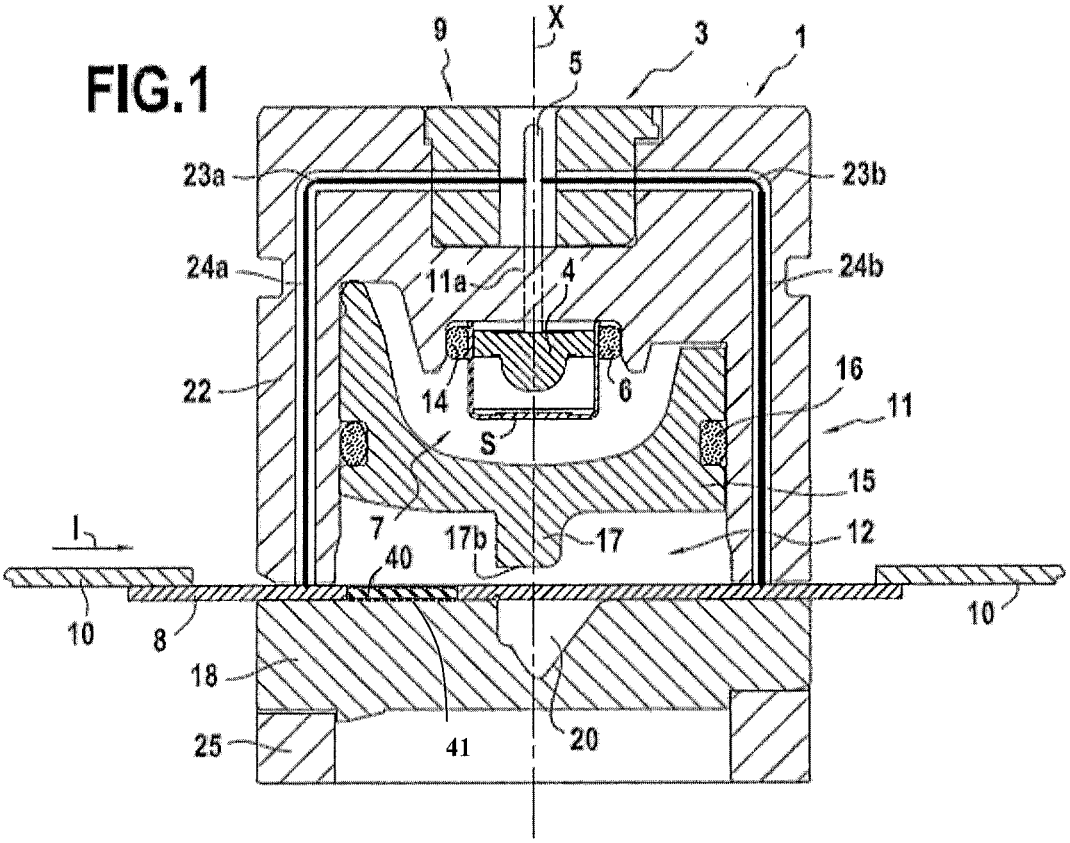
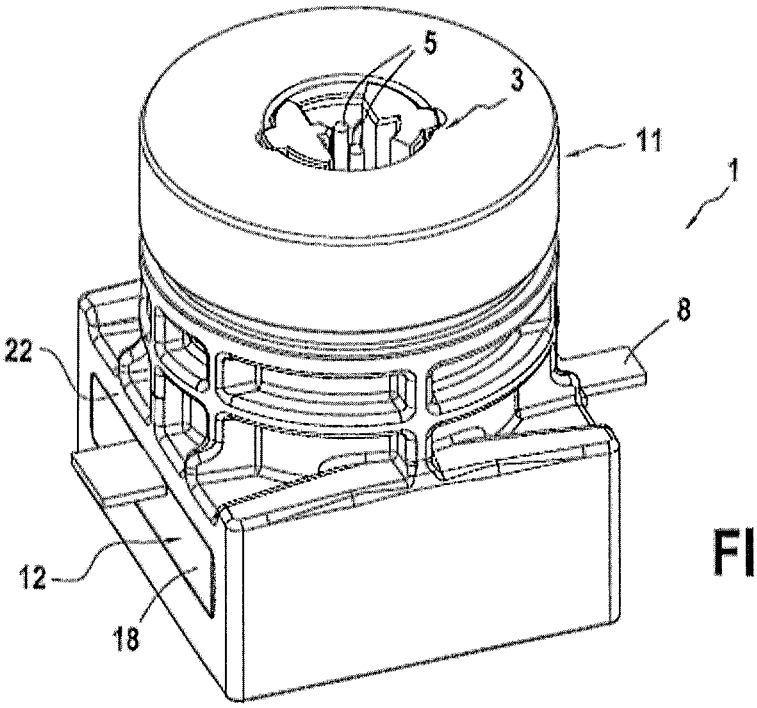
FIG.3

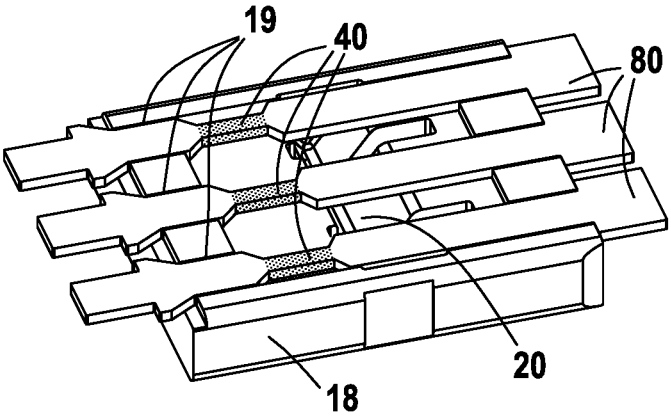
FIG.5
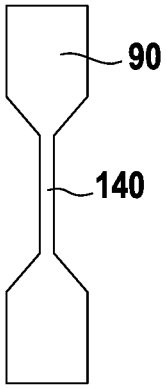
FIG.5A
FIG.6
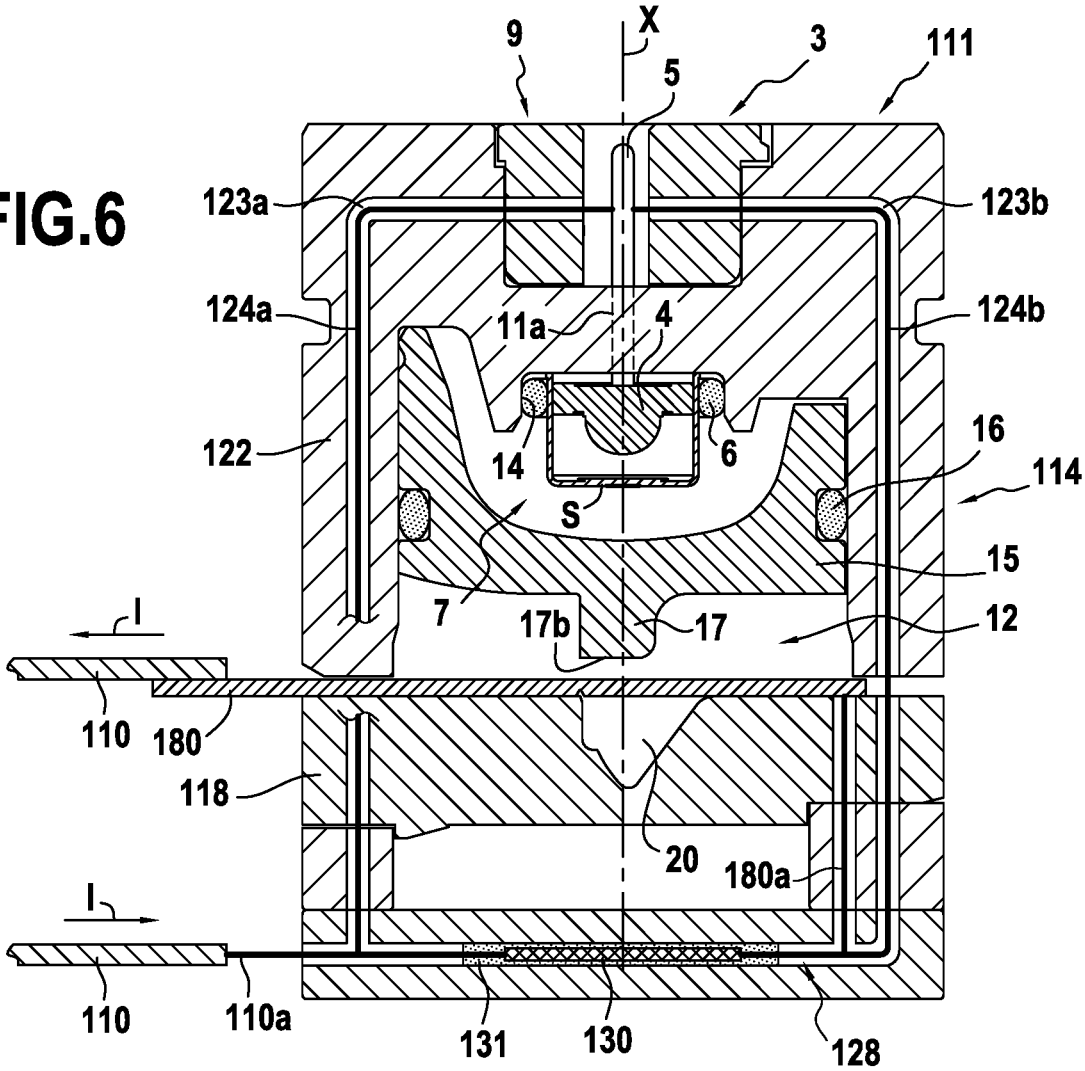

BREAKER DEVICE FOR CONNECTION TO AN ELECTRICAL CIRCUIT

CROSS REFERENCE TO RELATED APPLICATIONS

This application is the U.S. National Stage of PCT/FR2017/051168 filed May 15, 2017, which in turn claims priority to French Application No. 1654336, filed May 16, 2016. The contents of both applications are incorporated herein by reference in their entirety.

BACKGROUND OF THE INVENTION

The invention relates to a breaker device for interrupting electric current flowing in an electrical circuit, and also to a secure electrical system including such a breaker device.

Electrical circuits may be protected at present by placing fuses in each of the phases. Such fuses serve to interrupt the electric current in the event of a high current appearing for a specific duration, and they are reliable in use in the case of faults with high fault currents. Nevertheless, for currents that are only a little greater than the nominal currents, such fuses may take a relatively long time to break and may possibly break incompletely. A break that is incomplete or that takes place too late can lead to unacceptable damage to the electrical system, and in particular to an electrical device powered by the electrical circuit. It is therefore desirable to improve the quality of the circuit breaking performed in the event of a malfunction occurring so as to improve the security and the lifetime of electrical systems.

There therefore exists a need to provide breaker devices that are relatively simple and that enable the quality of circuit breaking to be improved.

OBJECT AND SUMMARY OF THE INVENTION

To this end, in a first aspect, the invention provides a breaker device for connecting in an electrical circuit, the device comprising at least one pyrotechnic initiator and a body having present therein:

- a pressurizing chamber in communication with an outlet from said pyrotechnic initiator;
- at least one electrically conductive portion for connection to the electrical circuit;
- at least one fusible element connected in series with the conductive portion, the initiator being connected to the terminals of said fusible element and said fusible element being configured to trip when the current passing through it exceeds a predetermined value, thereby actuating the initiator; and
- a movable breaker element;

the pyrotechnic initiator being configured to cause the breaker device to pass from a current-passing first configuration to a circuit-breaking second configuration, the movable breaker element being moved on passing from the first configuration to the second in order to disconnect said conductive portion.

On being actuated, the pyrotechnic initiator is configured to produce a pressurizing gas in order to pressurize the pressurizing chamber. The pressurizing gas exerts pressure on the movable breaker element so as to cause it to move. The movable breaker element moving in this way is configured to cause the device to pass into the second configuration in which the conductive portion is disconnected, i.e. a configuration in which the flow of electric current in the conductive portion is interrupted. Thus, when the device is in the second configuration, the electric current flowing in the electrical circuit is cut off.

The invention proposes a breaker device enabling circuit breaking to be performed quickly and reliably in a circuit in the event of excess electric current, thus making it possible to avoid damaging an electrical device powered by said circuit. More precisely, during normal operation of the system, the fusible element is conductive, and the voltage across the terminals of the fusible element is relatively low so that the current flowing through the igniter device of the pyrotechnic initiator is low enough to avoid initiating it. In contrast, when the current flowing through the fusible element exceeds the predetermined value, the fusible element trips, i.e. its resistance increases so as to initiate disconnection of the conductive portion. Thus, the voltage across the terminals of the fusible element increases when it trips, and as a result the current flowing through the igniter device increases, thereby serving to actuate the pyrotechnic initiator and cause the device to pass from the first configuration to the second so as to permanently interrupt the flow of current in the circuit. Another advantage of the invention is that a breaker solution is proposed that is compact and integrated insofar as the fusible element enabling the initiator to be triggered is present inside the breaker device and not outside it. The invention thus serves advantageously to simplify existing breaker systems by proposing an independent breaker device that directly integrates the element that will trigger circuit breaking, specifically the fusible element. This serves advantageously to avoid the need for an additional device to be present for sensing and/or analyzing voltage and/or current in order to enable the initiator to be triggered. Thus, combining breaking by means of the fusible element and breaking by moving the movable breaker element serves very significantly to improve the security of power supply systems in a manner that is relatively simple insofar as it makes it possible to ensure that complete breaking is performed independently and thereby to avoid situations in which the fusible element does not completely interrupt the current.

Advantageously, at least one resistor or diode may be connected in series in the line connecting the device for igniting the initiator to one of the terminals of the fusible element.

Such an embodiment serves advantageously to avoid any risk of the igniter device being degraded by the current flowing therethrough.

In an embodiment, the fusible element may be a separate component connected to the conductive portion. Under such circumstances, the fusible element constitutes an element that is distinct from the conductive portion and that is connected in series therewith, e.g. by soldering.

In a variant, the fusible element may be constituted by a narrow zone of the conductive portion. Under such circumstances, the conductive portion and the fusible element are constituted by the same material.

In an embodiment, the pressurizing chamber constitutes a first breaker device chamber, at least a fraction of the conductive portion being present in a second chamber that is present in the body, the movable breaker element separating the first chamber from the second chamber and presenting at least one projecting portion made of electrically insulating material, said at least one projecting portion facing the conductive portion, the movable breaker element being caused to move towards the conductive portion in order to break it by impact against the projecting portion on passing from the first configuration to the second.

Under such circumstances, the conductive portion is disconnected by being broken by impact against the projecting portion when the device passes from the first configuration to the second. Nevertheless, the present invention is not limited to such an embodiment in which the conductive portion is broken when the initiator is actuated.

Specifically, in another embodiment, the conductive portion presents a first electrically conductive element and a second electrically conductive element, and the movable breaker element presents a third electrically conductive element, the third electrically conductive element establishing electrical connection between the first and second conductive elements when the breaker device is in the first configuration, and the third conductive element being disengaged from at least one of the first and second conductive elements so as to prevent electric current flowing between them when the device is in the second configuration.

Under such circumstances, electric current can flow between the first conductor and the second conductor via the third conductor when the device is in the first configuration. In contrast, when the device is in the second configuration, the first and second conductors are no longer electrically connected, but without the conductive portion being broken. This electrical disconnection is the result of a conductive element of the movable breaker element moving when the device passes from the first configuration to the second configuration. Thus, under such circumstances, the conductive portion is disconnected by eliminating the electrical connection between at least two of its conductive elements, but without said conductive portion being broken as a result of the movable breaker element moving when the device passes from the first configuration to the second. As described in greater detail below, in this embodiment, the movable breaker element may be made entirely out of electrically conductive material, or it may include a third electrically conductive element together with an electrically insulating portion.

In an embodiment, the device may have a single conductive portion. Under such circumstances, the breaker device may be for connection a single-phase power supply circuit.

In a variant, the device may include a plurality of conductive portions, a respective fusible element being connected in series with each of the conductive portions, the initiator possibly being connected to the terminals of each fusible element and each fusible element possibly being configured to trip when the current passing through it exceeds the predetermined value so as to actuate the initiator. Under such circumstances, the breaker device may be for connection to a polyphase power supply circuit. By way of example, the polyphase power supply circuit may be a three-phase circuit, or in a variant it may have two phases or at least four phases. Unless specified to the contrary, the term "phase of the circuit" should be understood as the electrical conductor corresponding to said phase of the electrical circuit.

With a plurality of conductive portions, all of the conductive portions are electrically disconnected simultaneously when the device passes from the first configuration to the second configuration. This serves advantageously to perform a complete and simultaneous interruption of the current flowing in the circuit.

The invention also provides a secure electrical system comprising at least:

a secure power supply system comprising at least:

a breaker device as described above; and a power supply circuit connected to the breaker device, said at least one conductive portion being connected to a phase of the power supply circuit; and an electrical device connected to said power supply system in order to be powered thereby.

In an embodiment, the electrical system may also comprise a monitor element for monitoring the electrical device and configured to actuate the initiator when the value of an operating parameter of the electrical device reaches a predetermined value.

This embodiment is advantageous for achieving a complete break of the circuit in the event of a malfunction occurring in the electrical device that is to be powered but without necessarily involving excess current in the power supply circuit.

The operating parameter may be pressure or temperature. Thus, the monitor element of the electrical device may be configured to actuate the pyrotechnic initiator when the temperature of the electrical device or the pressure of at least a portion of the electrical device exceeds a predetermined value.

The present invention also provides a vehicle including at least one secure electrical system as described above. By way of example, the vehicle may be an aircraft, a train, or a car.

The present invention also provides an installation including at least one secure electrical system as described above.

By way of example, the electrical device may be a train motor. In a variant, the electrical device may be a heat pump or a power installation.

BRIEF DESCRIPTION OF THE DRAWINGS

Other characteristics and advantages of the invention appear from the following description of particular embodiments of the invention, given as non-limiting examples, and with reference to the accompanying drawings, in which:

FIG. 1 is a section view of a first example breaker device of the invention in the first configuration;

FIG. 3 is a perspective view of the FIG. 1 breaker device ready for connecting in an electrical circuit;

FIG. 5 is a detail of a second example breaker device of the invention;

FIG. 5A is a detail of a third example breaker device of the invention;

FIG. 6 is a section view of a fourth example breaker device of the invention in the first configuration;

DETAILED DESCRIPTION OF EMBODIMENTS

FIG. 1 is a section view of an example breaker device 1 of the invention. As described in detail below, in the example breaker device 1 shown in FIG. 1, the conductive portion breaks when the device 1 goes from the first configuration to the second configuration. Other arrangements are possible in the context of the present invention, as described below.

In FIG. 1, the device 1 is in the first configuration, i.e. a configuration in which electric current (arrow I) can flow in the phase 10 of the power supply circuit and in the conductive portion 8. In the example shown, the power supply circuit has a single phase and the breaker device 1 has a single conductive portion 8. Nevertheless, it would not go beyond the ambit of the invention for the circuit to have a plurality of phases and the breaker device to have a plurality of conductive portions, and one such embodiment is mentioned below.

Figure 2:
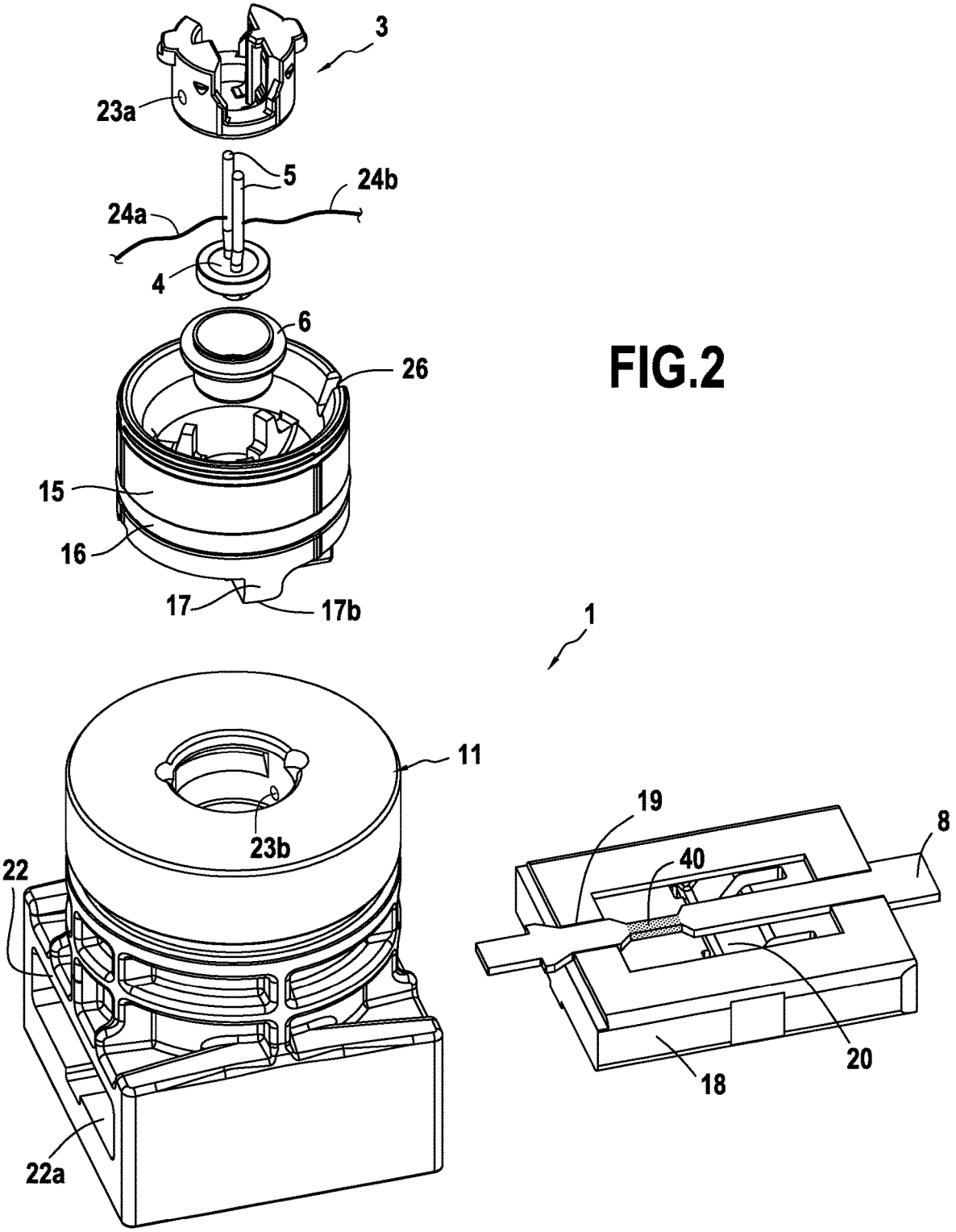
FIG. 2 is an exploded view showing the various component elements of the FIG. 1 device.

The breaker device 1 comprises a pyrotechnic initiator 3 having an igniter device 9 with two electrical conductors 5 (only one of the conductors being shown in FIG. 1, while both conductors 5 are visible in FIGS. 2 and 3). The pyrotechnic initiator 3 also has a pyrotechnic charge 4. The pyrotechnic charge 4 may be in the form of one or more solid blocks. In a variant, the charge 4 may be in granular form. Selecting the nature and the dimensions of the pyrotechnic charge to be used for the intended circuit breaker application comes within the general knowledge of the person skilled in the art.

The device 1 comprises a body 11 in which first and second chambers 7 and 12 are present. By way of example, the body 11 may be made of a thermoplastic or thermosetting material. The pyrotechnic initiator 3 has a sealing gasket 6 made of elastically deformable material pressing against an inside wall 14 of the body 11. In the example shown, the igniter device 9 is housed in the body 11. The body 11 also presents two through channels 11*a*, with each of the conductors 5 extending in a respective one of the channels 11*a*. The first chamber 7 constitutes a pressurizing chamber and it is in communication with an outlet S of the pyrotechnic initiator 3. On being actuated, the pyrotechnic initiator 3 is configured to pressurize the first chamber 7. In the example shown, the pyrotechnic charge 4 is present in the first chamber 7. Nevertheless, it would not go beyond the ambit of the invention for the charge to be present outside the first chamber so long as the chamber remains in communication with an outlet from the pyrotechnic initiator.

An electrically conductive portion 8 is present in the second chamber 12 (see FIGS. 1 and 3 in particular). The ends of the conductive portion 8 project from the body 11 in the example shown. In the example shown, the conductive portion 8 is in the form of a tongue. By way of example, the conductive portion 8 may be made of copper.

The conductive portion 8 is provided with a fuse 40 that is connected in series therewith. In this example, the fusible element 40 constitutes an element that is distinct from the conductive portion 8 and that has been fitted thereto. By way of example, the fuse 40 could be soldered or clipped to the conductive portion 8, In the example shown, the fuse 40 together with its insulating shell 41 has been soldered to the conductive portion 8. In this example, the fuse 40 comprises a fusible core present inside an electrically insulating shell 41, The insulating shell 41 may contain a powder of electrically insulating material, such as silica, with the fusible core present therein. Using a fusible core in association with its insulating shell serves advantageously to improve the lifetime of the fusible core, thereby further improving the reliability of the breaker device. In a variant, it would be possible for the conductive portion to incorporate only the fusible element of a commercial fuse (without its insulating shell 41), In addition, in this example, the fuse 40 is present in the second chamber 12, which is present inside the body 11.

Each electrical conductor 5 is connected to a distinct terminal of the fuse 40. More precisely, the side wall 22 of the body 11 has channels 23*a* and 23*b* through which the electrical conductors 24*a* and 24*b* extend. The first electrical conductor 24*a* connects a first terminal of the fuse 40 to a first conductor 5 of the igniter device 9. The second electrical conductor 24*b* connects a second terminal of the fuse 40, different from the first terminal, to a second conductor 5 of the igniter device 9, different from the first conductor. Thus, when an electric current greater than a predetermined value is conveyed by the phase 10 and the conductive portion 8, the fuse 40 trips. As a result, the resistance across the terminals of the fuse 40 increases, thereby giving rise to a potential difference that is sufficient to actuate the igniter device 9 and thus to break the electric current. Selecting the fuse characteristics that should be used in order to obtain circuit breaking at the desired current level comes within the general knowledge of the person skilled in the art. In particular, it may be observed that the fuse does not need to withstand a high voltage, which means that it is possible to use fuses having a relatively low breakdown voltage. The breaker device may be used in a system that involves a voltage of less than 100 volts (V), for example.

At least one resistor or diode (not shown) may advantageously be connected in series in the line connecting the fuse 40 to the igniter device 9 in order to reduce the current flowing through the igniter device 9 and thus avoid any degradation of the igniter device in the presence of the nominal current.

The conductive portion 8 is present on a support 18. In the example shown, the support 18 has the structure of a slide for engaging in an opening 22*a* in the side wall 22 of the body 11. The support 18 defines a recessed portion 20 situated under the conductive portion 8 when the device 1 is in the first configuration. The support 18 presents a groove 19 in which the conductive portion 8 is received. The conductive portion 8 is for connecting in a phase 10 of the power supply circuit. By way of example, this connection may be performed by soldering. The ends of the conductive portion 8 are connected in a phase 10 of the power supply circuit.

The example device 1 of FIG. 1 further comprises a movable breaker element 15 made of an electrically insulating material, e.g. polyetheretherketone (PEEK GF40) or polyphenylene sulfide (PPS). The breaker element 15 separates the first chamber 7 from the second chamber 12 in sealed manner. The breaker element 15 is situated between the first and second chambers 7 and 12. The breaker element 15 presents at least one projecting portion 17 facing the conductive portion 8. The breaker element 15 has a sealing gasket 16 made of an elastically deformable material that presses against a side wall 22 of the body 11. The side wall 22 surrounds the first and second chambers 7 and 12. The side wall 22 of the body 11 defines an inside volume in which the first and second chambers 7 and 12 are present, and in particular in which the fuse 40 is present. More precisely, in the example shown, the fuse 40 is present in the second chamber 12. The projecting portion 17 is in the form of a portion of extra thickness. In the example shown, the breaker device 15 has a single projecting portion 17 for breaking the conductive portion 8. The invention is not limited to any particular shape for the distal end 17*b* of the projecting portion 17 so long as the projecting portion 17 is suitable for breaking the conductive portion 8 by impacting thereagainst. By way of example, the distal end 17*b* of the projecting portion 17 may thus be plane in shape, as shown, or indeed it may be pointed or rounded in shape. As described in detail below, the breaker element 15 is configured to move along the travel axis X as a result of the pyrotechnic initiator 3 being actuated. When the device 1 is in the first configuration, the recessed portion 20, the conductive portion 8, and the projecting portion 17 are superposed along the axis X.

There follows a description of assembling the various elements of the breaker device 1 shown in FIGS. 1 to 3.

Initially, the body 11 is overmolded onto the pyrotechnic initiator 3. The breaker element 15 is then inserted by force through the bottom 25. As shown in FIG. 2, the breaker element 15 presents positioning means 26, specifically in the form of a notch, for co-operating with a projecting portion present on the inside wall of the body. This co-operation serves to prevent the breaker element 15 from turning and thus to ensure that it does not turn about the axis X when the first chamber 7 is pressurized by the pyrotechnic initiator 3. The conductive portion carrying the fuse 40 is then placed in the groove 19 in the support 18. The support 18 can then be inserted through an opening 22*a* in the side wall 22 of the body 11, across the travel axis X, and the wires 24*a* and 24*b* are then soldered to the terminals of the fuse 40. The breaker device 1 shown in FIG. 3 is thus obtained ready for connecting in a power supply circuit, e.g. by soldering the conductive portion 8 in the phase 10.

Figure 4A:
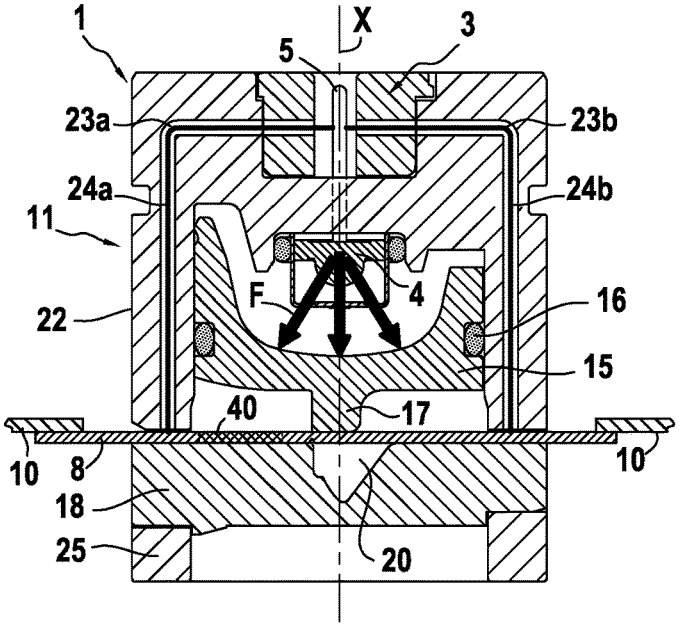
FIGS. 4A to 4C illustrate circuit breaking performed by the FIG. 1 device.
Figure 4B:
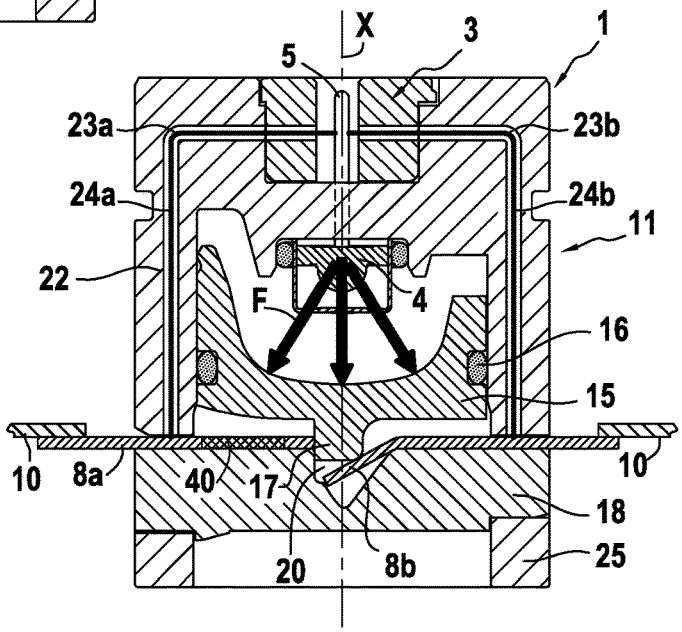
Figure 4C:
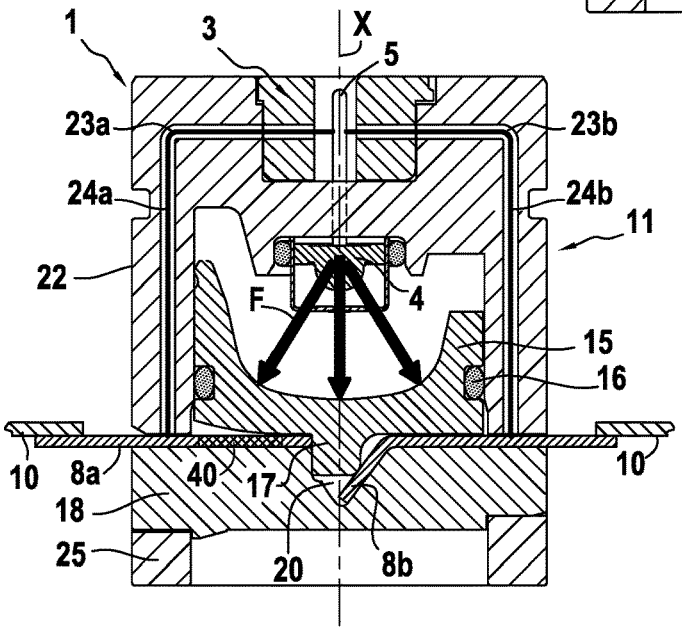

With reference to FIGS. 4A to 4C, there follows a description of the FIG. 1 breaker device 1 breaking a circuit.

The device 1 is initially in the first configuration in which an electric current (arrow I) can flow in the phase 10 and in the conductive portion 8 (the fuse 40 is conductive). While the device 1 is in the first configuration, the breaker element 15 is in a first position, referred to as a "high" position. When the current flowing in the conductive portion 8 exceeds a predetermined value, the fuse 40 trips. Thus, the resistance across the terminals of the fuse increases, thereby enabling the pyrotechnic initiator to be actuated. Actuating the pyrotechnic initiator 3 serves to cause the breaker device to go from the first configuration to a second configuration in which the flow of electric current in the conductive portion 8 is interrupted (conductive portion disconnected). More precisely, actuating the pyrotechnic initiator serves to initiate combustion of one or more pyrotechnic charges 4 so as to generate combustion gas (arrows F) that pressurizes the first chamber 7 (see FIG. 4A). This pressurizing of the first chamber 7 causes the breaker element 15 to move towards the conductive portion 8. The movable breaker element 15 is configured not to break when the first chamber 7 is pressurized by the pyrotechnic initiator. In the example shown, the breaker element 15 is configured to move without deforming as the device 1 passes from the first configuration to the second configuration. The breaker element 15 moves in translation along the axis X towards the conductive portion 8 during this passage from the first configuration to the second configuration. In particular, because of the presence of the positioning means 26, the movement of the breaker element 15 does not include any component in rotation about the axis X during this passage from the first configuration to the second. As a result of moving, the breaker element 15 impacts against the conductive portion 8 and thus breaks it (see FIGS. 4B and 4C). Breaking the conductive portion 8 in this way into a plurality of distinct portions 8*a* and 8*b* serves to prevent electric current flowing and thus to guarantee the security of the system. The breaker element is configured as shown to impact against the conductive portion 8 transversely, e.g. perpendicularly, relative to the flow direction of the electric current in that portion 8. In the example shown, the projecting portion 17 is received in the recessed portion 20 of the support 18 when the device 1 is in the second configuration, the projecting portion 17 thus coming into abutment against the bottom of the recessed portion 20. When the device is in the second configuration, the breaker element 15 is in a second position referred to as the "low" position, and the current is interrupted. This example device of the invention can serve advantageously to break a circuit particularly quickly, e.g. in about 0.2 milliseconds (ms). In the example shown, the projecting portion 17 impacts the conductive portion in a zone that is distinct from the zone in which the fuse 40 is present. Nevertheless, it would not go beyond the ambit of the invention for the device to be arranged in such a manner that the projecting portion impacts directly against and breaks the fuse incorporated in the conductive portion. The initiator may be selected to present dielectric isolation greater than the voltage of the system after operation.

A maintenance operation can be performed after the power supply circuit has been broken in order to remove the breaker device in the second configuration and replace it with a breaker device in the first configuration. The supply of power to the electrical device by means of the power supply circuit can then be restarted.

The example breaker device 1 described above with reference to FIGS. 1 to 3 and 4A to 4C is such that: (i) the circuit is broken by breaking the conductive portion 8 when it is impacted by the movable breaker element 15; and (ii) the fuse 40 is present in the second chamber 12 in which the conductive portion 8 is present. Other configurations could be envisaged in the context of the present invention, as described below.

FIG. 5 shows a detail of a breaker device in a variant embodiment of the invention. In this variant, the breaker device has a plurality of conductive portions 80. The breaker device having this plurality of conductive portions may be for use in a polyphase circuit. In the example shown, the breaker device is for connecting in a three-phase circuit. The number of conductive portions 80 in the breaker device may be equal to the number of phases in the circuit. Each of the conductive portions 80 is for connecting in a distinct phase of the circuit. Each conductive portion 80 presents a fuse 40 that is connected in series therewith. The remainder of the breaker device may be similar to that described in FIG. 1, except that the pyrotechnic initiator presents a plurality of igniter devices, each connected to the terminals of a respective one of the fuses. The conductive portions 80 are spaced apart from one another by a non-zero distance. Under such circumstances, the projecting portion of the breaker element is designed to break the various conductive portions 80 simultaneously when the pyrotechnic initiator is actuated. In the same manner as that described above, when an electric current greater than a predetermined value flows in one of the phases, the resistance across the terminals of the fuse associated with that phase increases so as to generate a potential difference across the terminals of the fuse that is sufficient to actuate the igniter device connected to that fuse and thus break the circuit. In a polyphase circuit, implementing such a breaker device serves advantageously to avoid situations in which at least one of the phases remains conductive after another phase has been broken, given that after the breaker device has been actuated, all of the conductive portions are broken simultaneously, thereby preventing any flow of current in the circuit.

FIG. 5A show a detail of a variant of the breaker device of the invention. In this example, the conductive portion 90 is made out of a single material and it presents a narrow zone 140 of reduced width and possibly also of reduced thickness. This narrow zone 140 is configured to melt when the current conveyed by the conductive portion 90 exceeds the predetermined value. An initiator is also connected to the terminals of the narrow zone 140 so as to trigger circuit breaking when the resistance of the narrow zone 140 increases, in similar manner to that described above. It is thus possible in the ambit of the present invention for the fusible element to be constituted by a constriction in the conductive portion itself, without needing to connect a separate fusible element in series therewith.

FIG. 6 shows a variant of the breaker device 111 of the invention in the first configuration, i.e. in a configuration in which an electric current (arrow I) can flow in the phase 110 of the power supply circuit and in the conductive portion 180. In the example shown, the device 1 comprises a body 114 having present therein: a first chamber 7; a second chamber 12; and a third chamber 128. The pyrotechnic initiator 3 presents the same structure as in the example of FIG. 1, and the same numerical references are repeated in FIG. 6 to designate elements that are the same as in FIG. 1.

The first chamber 7 constitutes a pressurizing chamber and it is in communication with an outlet S of the pyrotechnic initiator 3. In the example of FIG. 6, an electrically conductive portion 180 is present in the second chamber 12. Nevertheless, unlike the example of FIG. 1, the fusible element is not present in the second chamber 12. Specifically, in this example, the device 111 has a third chamber 128 containing a fusible element 130 and a powder 131 of electrically insulating material. In this example, the fusible element 130 is present inside the insulating powder 131. Such a configuration serves to still further improve the reliability of the breaker device by improving the time behavior of the fusible core. By way of example, the electrically insulating material may be silica. The fusible element 130 may be constituted by a fusible core of a commercial fuse that has been separated from its insulating shell. The fusible element 130 is connected to the phase 110 of the circuit via the electric connector 110*a*, and this element 130 is also connected in series with the conductive portion 180 via the electric connector 180*a*. The conductive portion 180 is connected to the phase 110 of the circuit so as to make it possible in normal operation for electric current to flow in the circuit through the breaker device 111.

Furthermore, each electrical conductor 5 is connected to a distinct terminal of the fusible element 130. As in the example of FIG. 1, the side wall 122 of the body 114 presents channels 123*a* and 123*b* through which electrical conductors 124*a* and 124*b* extend. The first electrical conductor 124*a* connects a first terminal of the fusible element 130 to a first conductor 5 of the igniter device 9. The second electrical conductor 124*b* connects a second terminal of the fusible element 130, different from the first terminal, to a second conductor 5 of the igniter device 9, different from the first conductor. Thus, when an electric current greater than the predetermined value passes through the phase 110, the resistance across the terminals of the fusible core increases, thereby generating a potential difference that is sufficient to actuate the igniter device 9 and thus break the circuit. In the same manner as in the example of FIG. 1, actuating the igniter device 9 serves to cause the movable breaker element 15 to move so as to break the conductive portion 8 by impacting thereagainst in order to interrupt the flow of electric current in the circuit.

In the example of FIG. 6, the first, second, and third chambers 7, 12, and 128 are superposed. The second chamber 12 is positioned between the first and third chambers 7 and 128 in this example. The conductive portion 180 is present on a support 118 having a slide structure similar to that described with reference to FIGS. 1 to 3. Nevertheless, in the example of FIG. 6, the channels 123*a* and 123*b* extend through the slide 118 so as to be capable of connecting the connectors 5 to the terminals of the fusible element 130.

Actuating the initiator causes the movable breaker element 15 to move towards the conductive portion 180 so as to break it, in a manner analogous to that described with reference to FIGS. 4A to 4C.

Figure 7A:
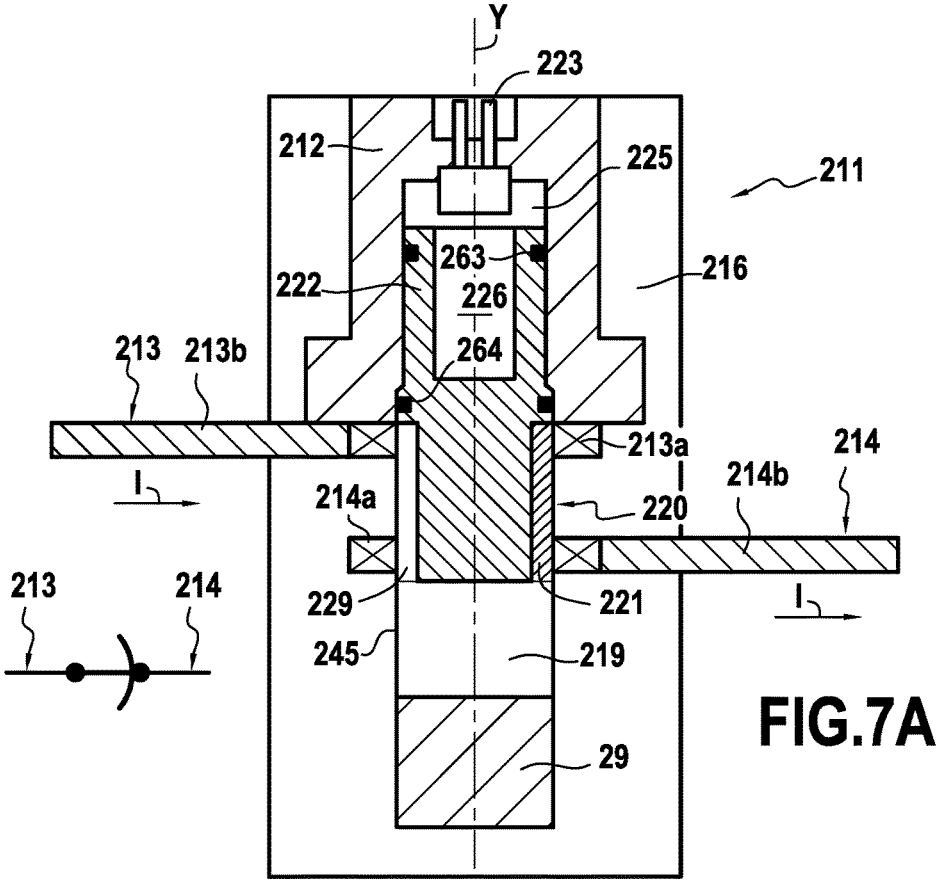
FIG. 7A is a section view of a fifth example breaker device of the invention in the first configuration.
Figure 7B:
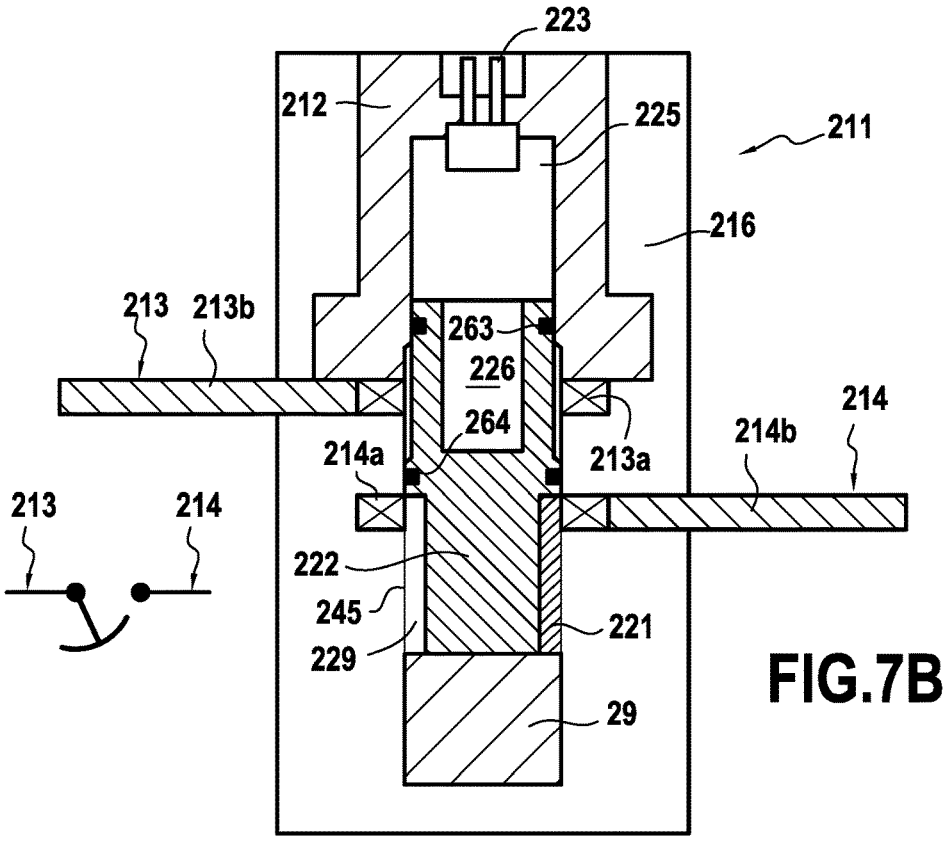
FIG. 7B is a section view of the FIG. 7A breaker device in the second configuration.
Figure 8:
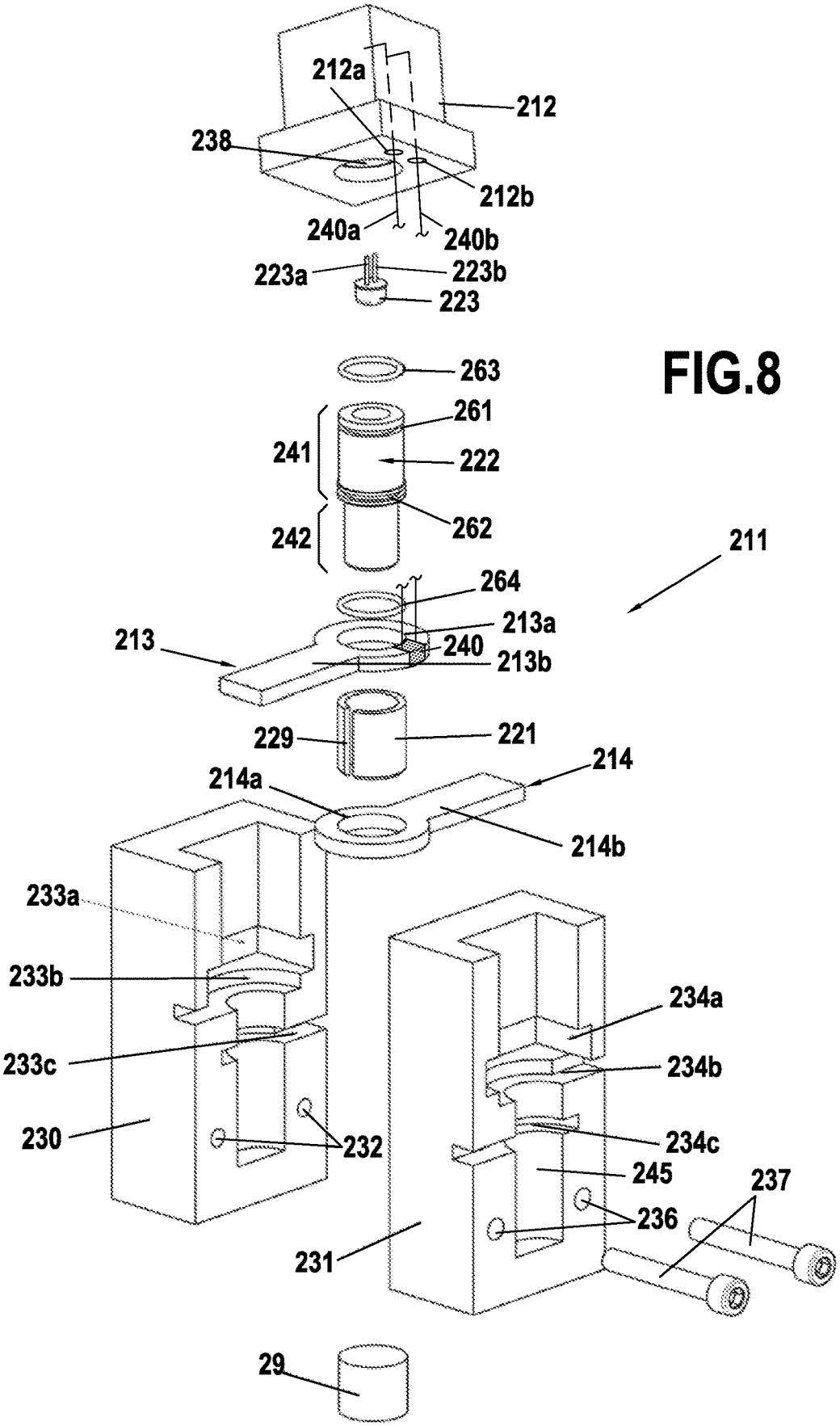
FIG. 8 is an exploded view showing the various component elements of the device shown in FIGS. 7A and 7B.

The above-described examples disconnect the conductive portion by breaking it by means of the movable breaker element. With reference to FIGS. 7A, 7B, and 8, there follows a description of an example breaker device of the invention in which the conductive portion is disconnected in a different manner.

The breaker device 211 has a hollow body 216 made of electrically insulating material defining a cavity 219, a pyrotechnic initiator 223, and a conductive portion having two primary electrically conductive tabs 213 and 214 that lead into the cavity 219. In this example, the conductive portion thus has a first electrically conductive element (conductive tab 213) and a second electrically conductive element (conductive tab 214). The first and second electrically conductive elements 213 and 214 are offset along the longitudinal axis Y of the cavity 219 in the example shown.

The breaker device 211 also has a movable breaker element 220 configured to move in the cavity 219. In this example, the cavity 219 is cylindrical and the movable breaker element 220 is itself essentially cylindrical. In the example shown, the movable breaker element 220 comprises a first portion made of an electrically insulating material and a second portion made of an electrically conductive material. The movable breaker element 220 comprises a split tube 221 including at least one electrically conductive element. In the example shown in FIGS. 7A, 7B, and 8, the split tube 221 is entirely electrically conductive. The split tube 221 presents a slot 229. The movable breaker element 220 also has a slide 222 made of electrically insulating material and forming a piston that is adapted to move inside the cavity so as to entrain therewith the split tube 221. In a variant, it would be possible to use a movable breaker element that is made entirely out of electrically conductive material in the example breaker device shown in FIG. 7A. Such an element could have a tube-forming first portion similar to the conductive tube 221 shown and a disk-forming second portion extending across the axis Y and closing the first portion.

When the device 211 is in the first configuration as shown in FIG. 7A, the split tube 221 (third conductive element) provides electrical connection between the tabs 213 and 214 (first and second conductive elements). This enables current to flow in the circuit through the conductive portion of the breaker device 211.

In this example, the pyrotechnic initiator 223 comprises a conventional pyrotechnic gas generator installed in the hollow body so as to communicate with the cavity 219. A pressurized chamber 225 is defined between the pyrotechnic initiator 223 and one of the axial end faces of the piston 222. More particularly, in this example, the piston 222 has a cavity 226 in its upstream face facing towards the pyrotechnic initiator 223, and this cavity 226 constitutes a portion of the pressurizing chamber 225. In the initial position in which the slide 222 is practically in contact with the initiator 223, i.e. with the pressurizing chamber 225 reduces to its minimum volume, both electrically conductive tabs 213 and 214 are electrically connected together via the split tube 221 in a first position referred to as an "initial" position. Electrical contact takes place via the third conductive element (specifically the split tube 221), as mentioned above.

The two conductive tabs have two respective rings 213*a* and 214*a* about the axis Y that are offset axially along that axis (which axis corresponds to the travel direction of the movable breaker element 220) and these rings 213*a* and 214*a* are in tight contact with the conductive portion of the movable breaker element (specifically the split tube 221) while it is in said first position. In this example, the inside faces of the rings 213*a* and 214*a* are flush with the wall of the cavity 219. Advantageously, in said first position, the split tube 221 is engaged as a force fit between the rings 213*a* and 214*a* of said primary conductive tabs 213 and 214, thereby guaranteeing an excellent electrical connection between said primary conductive tabs throughout the period preceding actuation of the breaker device 211.

In FIG. 8, one of the rings 213*a* in the example shown presents a fuse 240 that is connected in series therein. In the example shown, the fuse 240 together with its insulating shell is incorporated in the ring 213*a*. Nevertheless, without going beyond the ambit of the present invention, it would be possible to use a fusible element formed solely by the fusible core of a commercial fuse (without its insulating shell) or by a narrow zone of the ring, in a manner similar to that described above. The support-forming portion 212 of the pyrotechnic initiator 223 has two through channels 212*a* and 212*b*. A first electrical conductor 240*a* extends through a first channel 212*a* so as to connect a first electrically conductive portion 223*a* of the pyrotechnic initiator 223 to a first terminal of the fuse 240. In the same manner, a second electrical conductor 240*b* extends through a second channel 212*b* so as to connect a second electrical conductor 223*b* of the pyrotechnic initiator 223, different from the first conductor 223*a*, to a second terminal of the fuse 240, different from the first terminal. Thus, when a current greater than the predetermined value passes through the ring 213*a*, the resistance of the fuse 240 increases so as to create a potential difference across its terminals that is sufficient to be capable of actuating the pyrotechnic initiator 223. In a variant or in combination, a fusible element connected to the pyrotechnic initiator could be present in the electrical tab 214, being connected in series therewith.

On actuation of the pyrotechnic initiator 223, the movable breaker element 220, and consequently the split tube 221, moves towards a second position in the cavity (FIG. 7B) as a result of the pressurizing chamber 225 being pressurized. In this second position, the split tube 221 is disengaged from the tab 213, thereby preventing electrical connection between the two conductive tabs 213 and 214 and interrupting the flow of current in the circuit. In the example shown, when the device 211 is in the breaking, second configuration (as shown in FIG. 7B), the split tube 221 is separated from the tab 213 and is in contact with the tab 214. Nevertheless, it would not go beyond the ambit of the invention if the split tube were to be in contact neither with the tab 213 nor with the tab 214 when the device is in the second configuration.

FIG. 8 shows how the above-described breaker device 211 can be made simply and inexpensively. The hollow body 216 is defined by assembling together two housing elements 230 and 231, respectively a left element 230 and a right element 231. The housing element 230 has two tapped blind holes 232 surmounted by a laterally open indentation 233*a*, 233*b*, and 233*c* of shape defined to receive a portion of each of the electrically conductive tabs 213 and 214, and a portion of the support 212 of the pyrotechnic initiator. Each electrically conductive tab has a ring 213*a* or 214*a* that is extended laterally by a connection bar 213*b* or 214*b* that projects outside the insulating hollow body so as to be capable of being connected in the electrical circuit outside the breaker device 211. The second housing element 231 has two through holes 236 enabling fastener screws 237 to be inserted. In the same manner as the first housing element 230, it also has a laterally open indentation 234*a*, 234*b*, and 234*c* of a shape that is defined to receive a portion of each of the electrically conductive tabs 213 and 214, and a portion of the support 212 of the pyrotechnic initiator. The support 212 is mounted between the two housing elements 230 and 231 and it includes a hole 238 that receives the initiator 223 at its end. The initiator 223 is mounted inside said support 212 so as to define the pressurizing chamber 225 inside said hole 238. As mentioned above, the split tube 221 is engaged by force in each of the two rings 213*a* and 214*a*.

In this manner, in said initial, first position, the two rings 213*a* and 214*a* on a common axis along which they are axially offset are connected together electrically via the split metal tube 221. In the example shown, the insulating slide 222 is inserted inside the slidable split tube 221. An upstream or first portion 241 of cylindrical shape and of diameter substantially equal to the diameter of the cavity 219 slides along the inside faces of said cavity. In its upstream face that faces upwards in FIGS. 7A, 7B, and 8, the first portion 241 includes a cavity 226, which cavity is likewise substantially cylindrical in this example, that serves to define a portion of the initial volume of the pressurizing chamber 225. As can be seen in FIG. 8, the first portion 241 has two circumferential grooves 261, 262 that are axially spaced apart from each other, each of which receives a respective sealing ring 263, 264. Thus, the piston 222 closes the pressurizing chamber 225 and enables pressure to rise rapidly in the closed environment of this chamber. Thus, the gas generated in the pressurizing chamber 225 does not infiltrate towards the conductive rings 213*a* and 214*a*.

A slot is advantageously formed in at least one of said grooves and is configured to form a calibrated passage for discharging air from the pressurizing chamber while assembling the piston 222 in the support 212 of the pyrotechnic initiator 223. The piston 222 situated at least in part upstream from the split tube, serves to transmit to said tube 221 the pressure force generated by the gas in the pressurizing chamber 225 so as to enable the circuit to be broken by moving said tube 221. The first portion 241 is extended by a downstream, second portion 242 of slightly smaller diameter that is selected to enable it to be inserted, possibly by force, into the inside of the split tube once it has been inserted between the rings 213*a* and 214*a*. This second portion may serve as a guide element for the split tube as it moves inside the cavity 219. In an advantageous embodiment, it may also form a clamping element additional to the split tube against the rings 213*a* and 214*a*. FIG. 7B shows the situation after the pyrotechnic initiator 223 has been triggered. The electrical connection between the two tabs 213 and 214 is interrupted and the flow of electric current through the conductive portion of the breaker device 211 is thus interrupted. In this example, it should be observed that, over a portion that is situated directly upstream from the spilt tube, the piston 222 presents a diameter that is equal to no more than the outside diameter of the tube when inserted between the rings. In the example shown, the diameter of the upstream portion of the piston is even a little smaller than that of the split tube so that, while driving the split tube, the piston can slide easily between the rings without remaining jammed between them. This is made possible in this example by a small difference in diameter between the furthest upstream portion of the cavity along which the piston slides (formed in this example by the bore of the initiator support) and its downstream portion (formed by the housing elements) that is larger and into which the rings lead.

As can be seen in the drawings, the cavity 219 is extended downstream by a guide portion 245 that serves to guide the split tube 221 when it passes from the first position to the second so as to ensure that it follows a rectilinear path. A damping pad 29 is inserted in the bottom of the cavity 219. Where necessary, the damping pad 29 serves to reduce the energy of the impact of the conductive split tube 221 and the insulating piston 222 when these two parts come into contact with the bottom of the body 216.

Figure 9:
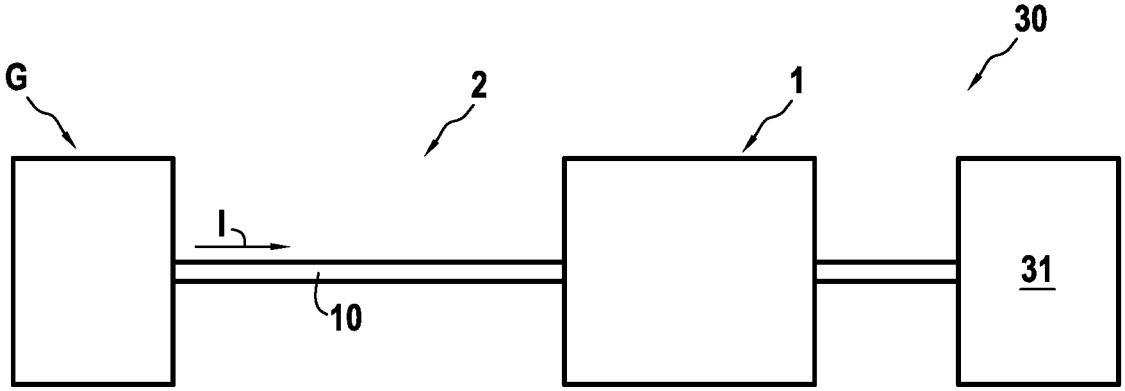
FIG. 9 is a block diagram of an example electrical system made secure in accordance with the invention.

FIG. 9 shows a first example of an electrical system 30 made secure in accordance with the invention. The secure electrical system 30 comprises a secure power supply system 2 connected to an electrical device 31 that is to be powered by the power supply system 2. The power supply system 2 comprises a single phase power supply circuit having an electricity generator G and a single phase 10 connected to the generator G. By way of example, the generator G may be an alternator. The generator G may be connected to an engine such as a piston engine or a turbojet. In a variant, the generator G may form part of an installation such as a power station that produces alternating current. In this example, the breaker device 1 shown in FIG. 1 is connected in the phase 10 as described in detail above. The breaker device 1 is connected in series with the generator G and with the electrical device 31. The breaker device 1 is present between the generator G and the electrical device 31. The generator G is present upstream from the breaker device 1 and the electrical device 31 is present downstream from the breaker device 1. The terms "upstream" and "downstream" are used herein relative to the flow of power in the power supply circuit (arrow I). As explained above, when the current conveyed by the phase 10 exceeds the predetermined value, the tripping of the fuse 40 present in the breaker device 1 serves to actuate the pyrotechnic initiator 3 and thus break the circuit.

Figure 10:
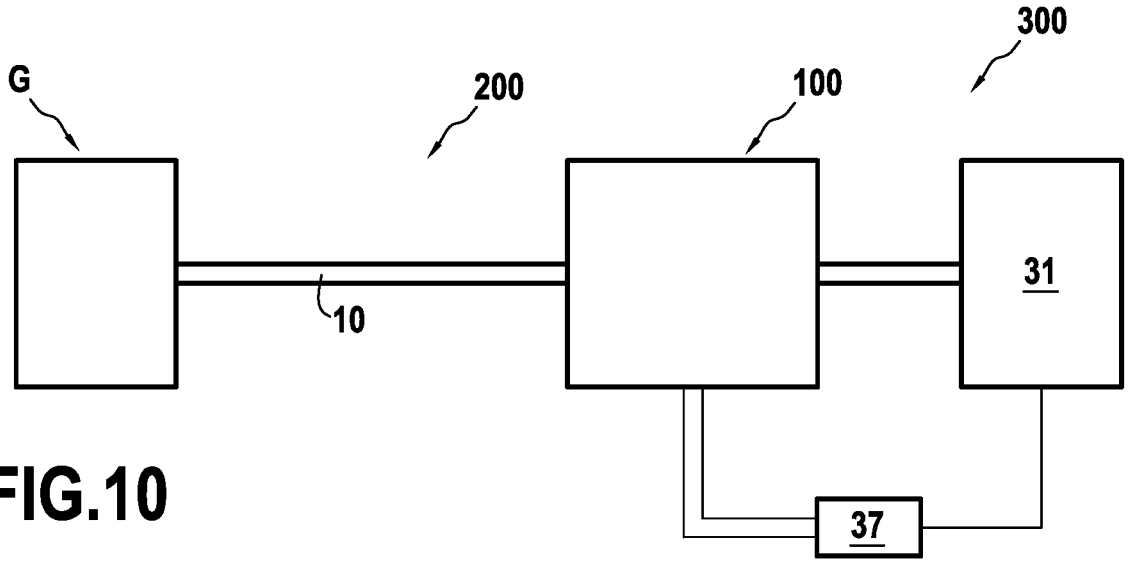
FIG. 10 is a block diagram of a variant electrical system made secure in accordance with the invention.

FIG. 10 shows another example 300 of an electrical system and a power supply system made secure in accordance with the invention. In the example of FIG. 10, a structure similar to that of FIG. 9 is used in which a monitor element 37 for monitoring the electrical device 31 has been added. This monitor element 37 is connected to the igniter device of the breaker device 100. The monitor element 37 is configured to actuate the pyrotechnic initiator when an operating parameter of the electrical device reaches a predetermined value. This makes it possible for the breaker device 100 to interrupt the flow of electricity also in the event of a malfunction of the electrical device 31 and not only in the event of excess current flowing in that circuit. By way of example, the monitor element 37 may comprise a terminal sensor configured to measure the temperature of the electrical device 31. In a variant, or in combination, the monitor element 37 may comprise a pressure sensor configured to measure the pressure in a portion at least of the electrical device 31. Thus, the monitor element 37 may be configured to actuate the pyrotechnic initiator when the temperature of the electrical device 31 or the pressure of a portion of said device 31 exceeds a predetermined value, thereby guaranteeing security of the system 300 in the event of a malfunction being observed.

The above-described secure electrical systems 30 and 300 may be mounted in a vehicle such as an aircraft or a train or they may be present in an industrial installation.

What is claimed is:

1. A breaker device for connecting to an electrical circuit, the device comprising at least one pyrotechnic initiator and a body having present therein:

a pressurizing chamber in communication with an outlet from said pyrotechnic initiator and constituting a first breaker device chamber;

at least one electrically conductive portion for connection to the electrical circuit, at least a fraction of the conductive portion being present in a second chamber that is present in the body;

at least one fusible element connected in series with the conductive portion, the initiator being connected to the terminals of said fusible element and said fusible element being configured to trip when the current passing through it exceeds a predetermined value, thereby actuating the initiator; and a movable breaker element separating the first chamber from the second chamber and presenting at least one projecting portion made of electrically insulating material, said at least one projecting portion facing the conductive portion;

the pyrotechnic initiator being configured to cause the breaker device to pass from a current-passing first configuration to a circuit-breaking second configuration, the movable breaker element being moved towards the conductive portion in order to break it by impact against the projecting portion in a zone that is distinct from a zone where the fusible element is present on passing from the first configuration to the second configuration; and either the fusible element being present in the second chamber and having an insulating shell, or the fusible element being present in a third chamber distinct from the second chamber; and having a powder of electrically insulating material also being present in the third chamber.

2. A device according to claim 1, wherein the fusible element is a separate component connected to the conductive portion.

3. A breaker device according to claim 1, the device having a single conductive portion.

4. A breaker device according to claim 1, wherein the breaker device has a plurality of conductive portions, a respective fusible element being connected in series with each of the conductive portions, the initiator being connected to the terminals of each fusible element and each fusible element being configured to trip when the current passing through it exceeds the predetermined value so as to actuate the initiator.

5. A secure electrical system comprising at least:

a secure power supply system comprising at least:

a breaker device according to claim 1; and a power supply circuit connected to the breaker device, said at least one conductive portion being connected to a phase of the power supply circuit; and an electrical device connected to said power supply system in order to be powered thereby.

6. A system according to claim 5, further comprising a monitor element for monitoring the electrical device and configured to actuate the initiator when the value of an operating parameter of the electrical device reaches a predetermined value.

7. A system according to claim 6, the operating parameter being pressure or temperature.

8. A vehicle including at least one secure electrical system according to claim 5.

9. An installation including at least one system according to claim 5.

* * * * *